US010661191B1

(12) United States Patent
Reeves

(10) Patent No.: US 10,661,191 B1
(45) Date of Patent: May 26, 2020

(54) INTERACTIVE ELECTRONIC TOY

(71) Applicant: Alana Reeves, Oak Park, IL (US)

(72) Inventor: Alana Reeves, Oak Park, IL (US)

( * ) Notice: Subject to any disclaimer, the term of this patent is extended or adjusted under 35 U.S.C. 154(b) by 0 days.

(21) Appl. No.: 16/184,361

(22) Filed: Nov. 8, 2018

(51) Int. Cl.

| | |
|---|---|
| ***A63H 3/28*** | (2006.01) |
| ***A63H 30/04*** | (2006.01) |
| ***A63H 3/00*** | (2006.01) |
| ***A63H 29/22*** | (2006.01) |
| ***A63H 13/04*** | (2006.01) |

(52) U.S. Cl.
CPC ..... *A63H 29/22* (2013.01); *A63H 3/00* (2013.01); *A63H 3/003* (2013.01); *A63H 3/006* (2013.01); *A63H 3/28* (2013.01); *A63H 13/04* (2013.01); *A63H 30/04* (2013.01); *A63H 2200/00* (2013.01)

(58) Field of Classification Search
CPC ..... A63H 3/00; A63H 3/003; A63H 3/006; A63H 3/36; A63H 30/04; A63H 33/26; A63H 2200/00
See application file for complete search history.

(56) References Cited

U.S. PATENT DOCUMENTS

| | | | | |
|---|---|---|---|---|
| 2,509,135 | A * | 5/1950 | Coplan | A63H 7/06 446/363 |
| 4,208,834 | A * | 6/1980 | Lin | A63H 3/06 446/226 |
| 4,355,482 | A * | 10/1982 | Sapkus | A63H 11/10 446/279 |
| 4,846,752 | A * | 7/1989 | Combs | A63H 11/10 446/279 |
| 6,544,098 | B1 | 4/2003 | Hampton et al. | |
| 2007/0293124 | A1 * | 12/2007 | Smith | A63H 17/02 446/454 |
| 2016/0122956 | A1 * | 5/2016 | Christiansen | B60P 3/0255 180/2.2 |

* cited by examiner

*Primary Examiner* — Eugene L Kim
*Assistant Examiner* — Alyssa M Hylinski
(74) *Attorney, Agent, or Firm* — Sanchelima & Associates, P.A.; Jesus Sanchelima; Christian Sanchelima

(57) ABSTRACT

The present invention is disclosing an interactive electronic toy that comprises a first microprocessor configured to determine a mode of operation. In an instance in which mode of operation is a first mode, a receiver is configured to receive one or more control signals from a remote control unit. In an instance in which mode of operation is a second mode, one or more sensors are configured to detect one or more events in a defined proximity area. A set of output devices and/or a set of motorized wheels are configured to be activated based on said received one or more control signals or said detected one or more events.

13 Claims, 3 Drawing Sheets

INTERACTIVE ELECTRONIC TOY

BACKGROUND OF THE INVENTION

1. Field of the Invention

The present disclosure relates to an interactive electronic toy. More particularly, the present disclosure relates to an interactive electronic toy for engaging a user.

2. Description of the Related Art

In order to keep a child interested in playing with a toy for extended time, various kinds of electronic toy characters are developed that can interact with the child. However, such electronic toy characters are very costly and complicated due to a variety of electronic and mechanical components incorporated therein.

Several designs for interactive toys have been presented in the past. None of them, however, presents a simple, cost-effective, user friendly, and simple to use, that can engage the user for extended time.

Applicant believes that a related reference corresponds to U.S. Pat. No. 6,544,098B1 by David Mark Hampton that discloses an interactive toy for toy can take the form of a small animal-like creature having a variety of moving body parts that have very precisely controlled and coordinated movements thereof so as to provide the toy with life-like mannerisms. The toy utilizes sensors for detecting sensory inputs which dictate the movements of the body parts in response to the sensed inputs. The sensors also allow several of the toys to interact with each other. The body parts are driven for movement by a single motor which is relatively small in terms of its power requirements given the large number of different movements that it powers. However, such interactive toy is quite costly and requires a variety of electronic and mechanical components for operation.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide an interactive electronic toy. Interactive electronic toy may comprise a first microprocessor configured to determine a mode of operation. Interactive electronic toy may comprise a receiver configured to receive one or more control signals from a remote control unit, in an instance in which mode of operation is a first mode. Interactive electronic toy may further comprise one or more sensors configured to detect one or more events in a defined proximity area in an instance in which mode of operation is a second mode. Interactive electronic toy may further comprise a set of output devices and/or a set of motorized wheels configured to be activated based on received one or more control signals or detected one or more events. In an embodiment, first mode is a manual mode and second mode is an automatic mode.

Set of output devices may comprise a plurality of multi-colored light emitting diodes (LEDs) and a speaker device. Set of motorized wheels may impart a forward, backward, sideways and spinning movement to interactive electronic toy. Interactive electronic toy may further comprise a first set of control buttons configured to be manipulated to power on/off interactive electronic toy, deactivate activated set of output devices, and/or deactivate activated set of motorized wheels. Interactive electronic toy may further comprise a first charging terminal configured to charge a rechargeable battery pack installed in interactive electronic toy.

Remote control unit may comprise a transmitter configured to transmit one or more control signals to interactive electronic toy via a communication network. Communication network is one of a long distance communication network or a short distance communication network. Remote control unit may further comprise a second set of control buttons configured to generate one or more control signals, wherein one or more control signals include powering on remote control unit, or switching on a plurality of multi-colored LEDs in interactive electronic toy. Remote control unit may further comprise a set of input devices configured to generate one or more control signals, wherein one or more control signals remotely control movement of set of motorized wheels. Remote control unit may further comprise a second charging terminal configured to charge a rechargeable battery pack installed in remote control unit.

Further objects of the invention will be brought out in the following part of the specification, wherein detailed description is for the purpose of fully disclosing the invention without placing any limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
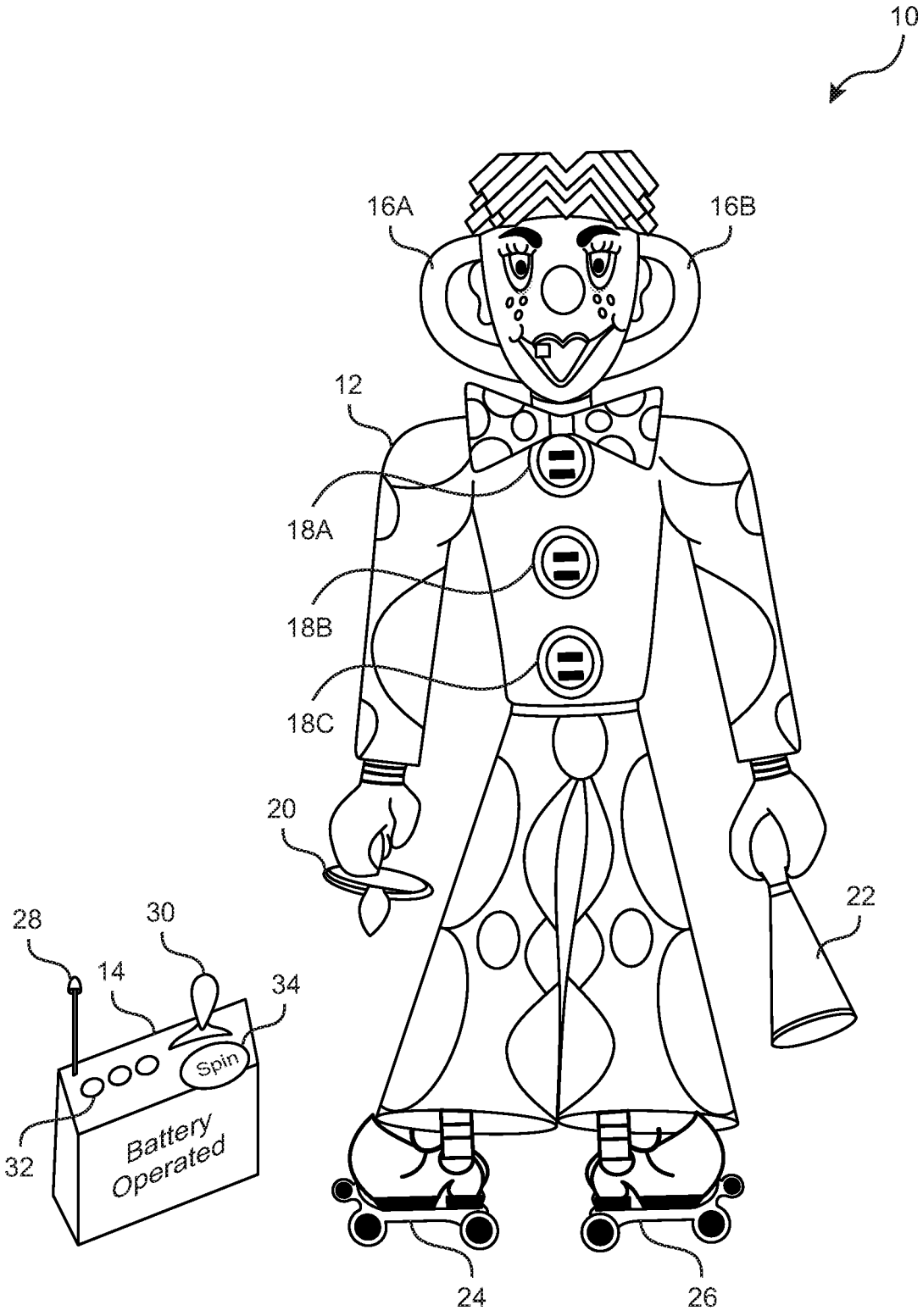
FIG. 1 represents an interactive electronic toy 12 of present invention in its operating environment 10, according to an embodiment described herein.

Referring now to the drawings, FIGS. 1-3, where the present invention is generally referred to with numeral 12, it can be observed that an interactive electronic toy, in accordance with one embodiment, is provided that includes various components, a described hereinafter.

FIG. 1 illustrates interactive electronic toy 12 of the present invention in its operating environment 10, according to an embodiment described herein. Operating environment 10 may include interactive electronic toy 12 and remote control unit 14. As illustrated in FIG. 1, interactive electronic toy 12 may be in form of a fun clown. However, the disclosure may not be so limited and other animal, superhero, or a doll character form may also be realized, without deviating from the scope of the disclosure.

Referring to FIG. 1, there is shown a fun clown as interactive electronic toy 12 comprising a funny face having handle-like ears 16A and 16B, in addition to other features, such as colorful hair made up of felt, wide green and blue eyes, uplifted brows, red nose, single tooth, red, blue and green freckles, white face, and white torso with three big buttons 18A, 18B, and 18C of red, blue, and green color, respectively. Arms of interactive electronic toy 12 are covered with sleeves and legs covered with pants having red, blue, and green color in specific pattern. Interactive electronic toy 12 is further illustrated to wear two white shoe skates having motorized wheels 24 and 26. In one hand, interactive electronic toy 12, i.e. fun clown, may be holding a pacifier 20, and in the other hand, a horn 22. Remote control unit 14 may include an antenna 28, a joystick 30, a spin button 34, and three LED activation buttons 32.

Figure 2:
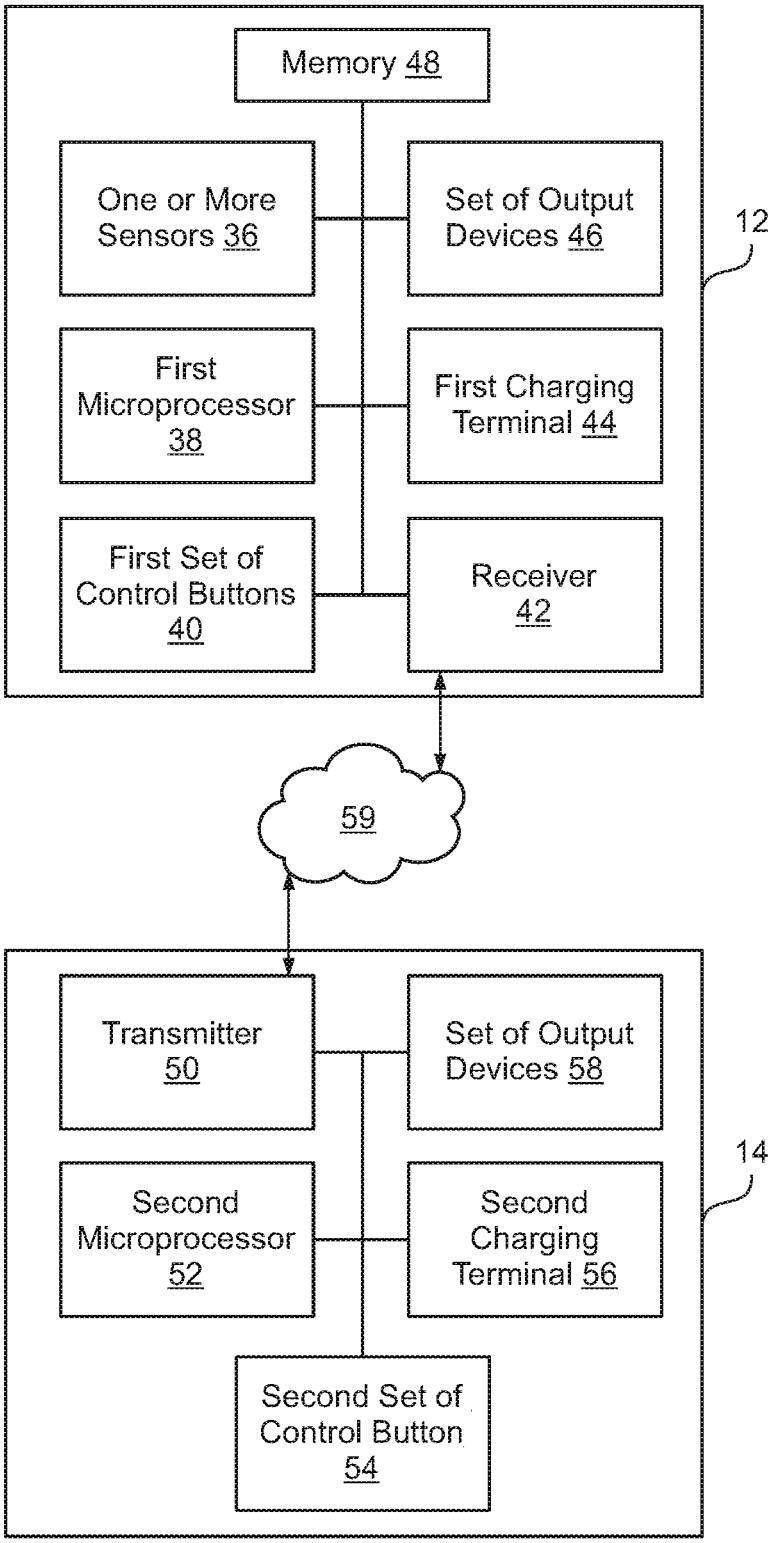
FIG. 2 demonstrates a block diagram of interactive electronic toy 12 and remote control unit 14, according to various embodiments described herein.

Referring to FIG. 2, there is demonstrated block diagram of interactive electronic toy 12 and remote control unit 14, according to various embodiments described herein. Interactive electronic toy 12 may include one or more sensors 36, a first microprocessor 38, a first set of control buttons 40, a receiver 42, a first charging terminal 44, a set of output devices 46, and a memory 48. Remote control unit 14 may include a transmitter 50, a second microprocessor 52, a second set of control buttons 54, a second charging terminal 56, and a set of input devices 58. Interactive electronic toy 12 and remote control unit 14 may communicate with each other via communication network 59.

One or more sensors 36, such as contact sensor, proximity sensor or pressure sensor, audio sensor, may be configured to detect an event associated with interactive electronic toy 12 and generate a signal. Event may correspond to a clapping sound created by user, an audio command provided by user, a touch gesture provided on pacifier 20, a press gesture provided on horn 22, and the like. Generated signal may cause first microprocessor 38 to activate, for example at least set of output devices 46, based on detected event.

First microprocessor 38 and second microprocessor 52 may be configured to activate plurality of electronic units, such as set of output devices 46, based on signal received from one or more sensors 26, first set of control buttons 40, second set of control buttons 54, or set of input devices 58. First microprocessor 38 and second microprocessor 52 may be an ×86-based processor, a Reduced Instruction Set Computing (RISC) processor, an Application-Specific Integrated Circuit (ASIC) processor, a Complex Instruction Set Computing (CISC) processor, a microcontroller, a central processing unit (CPU), a digital signal processor (DSP), a graphics processor unit (GPU), a coprocessor, and/or other processors or integrated circuits.

First set of control buttons 40 may include a plurality of hardware buttons configured to perform various settings on interactive electronic toy 12. For example, first set of control buttons 40 may include a power button configured to be manipulated to power on/off interactive electronic toy 12. In another example, first set of control buttons 40 may include a deactivation button configured to be manipulated to deactivate activated set of output devices 46, and/or deactivate activated set of motorized wheels 24 and 26.

Receiver 42 and transmitter 50 may correspond to electronic components configured according to a defined communication technology. Receiver 42 and transmitter 50 may implement known communication protocols in accordance with defined communication technology. Accordingly, receiver 42 in interactive electronic toy 12 may be configured to receive control signals transmitted by transmitter 50 in remote control unit 14, via communication network 59. In an embodiment, communication network 59 may be a short distance communication network. In another embodiment, communication network 59 may be a long distance communication network.

First charging terminal 44 and second charging terminal 56 may be configured to supply power supply to battery packs of interactive electronic toy 12 and remote control unit 14, respectively. Battery packs may be configured to provide power to plurality of electronic and electrical components of interactive electronic toy 12 and remote control unit 14. In an embodiment, battery packs may be powered from an external power supply via a power cable (not shown). In an embodiment, a battery pack may be a lithium-ion battery that is small, durable, and having long life. Alternatively, battery pack may be a chargeable battery that may be recharged when power level drops below a threshold power level.

Set of output devices 46 may be devices that may be configured to generate output signals for user. For example, set of output devices 46 may include an audio beeper that may generate beeps upon activation by first microprocessor 38 and/or second microprocessor 52. Rendering pattern of audio beeps and plurality of pre-recorded music files that may be retrieved by first microprocessor 38 and/or second microprocessor 52 from memory 48 based on a selection provided by a user via first set of control buttons 40 and/or second set of control buttons 54. Various examples of set of output devices 46 may comprise a plurality of multi-colored light emitting diodes (LEDs) and a speaker device in interactive electronic toy 12.

Memory 48 may be configured to temporarily store various data, such as rendering pattern of audio beeps and plurality of pre-recorded music files that may be retrieved by first microprocessor 38 based on a selection provided by a user via first set of control buttons 40 and/or second set of control buttons 54.

Second set of control buttons 54 may include a plurality of hardware buttons configured to perform various operations on interactive electronic toy 12. For example, second set of control buttons 54 may include a spin button 34 configured to be manipulated to impart a spinning movement to interactive electronic toy 12. In another example, second set of control buttons 54 may include three LED activation buttons 32 configured to be manipulated to switch on multi-colored LED lights installed in interactive electronic toy 12. In another example, second set of control buttons 54 may include power button configured to be manipulated to power on/off remote control unit 14.

Set of input devices 58 may include a plurality of hardware devices configured to provide an input to perform an operation on interactive electronic toy 12. For example, set of input devices 58 may include joystick 30 configured to be manipulated to impart forward, backward, and sideways movement to interactive electronic toy 12.

Figure 3:
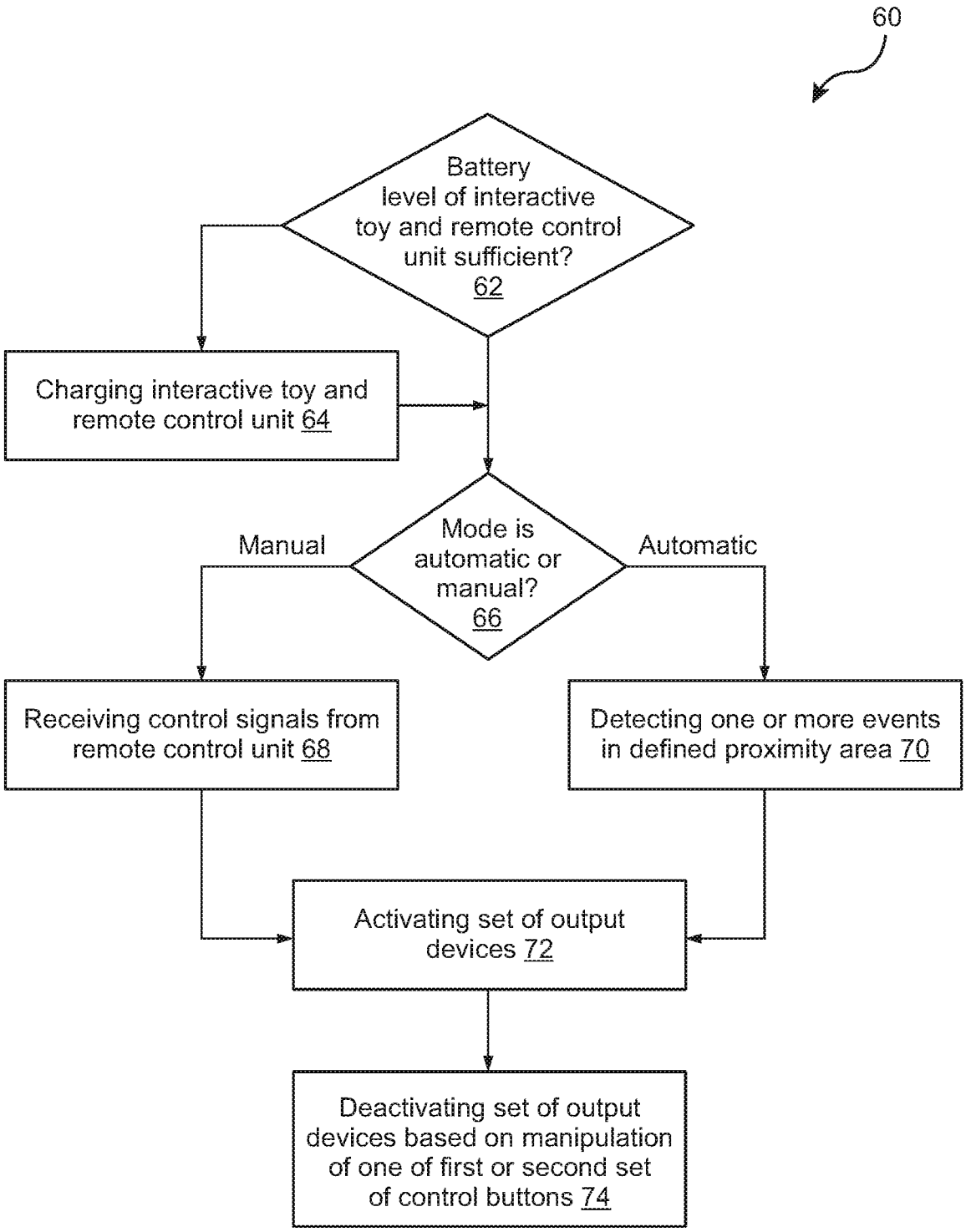
FIG. 3 is a flowchart for illustrating a method implemented by interactive electronic toy 12, according to an embodiment described herein.

FIG. 3 is a flowchart 60 for illustrating a method implemented by interactive electronic toy 12, according to an embodiment described herein.

At step 62, it may be checked whether battery levels of interactive electronic toy 12 and remote control unit 14 are sufficient. In an embodiment, when battery levels of interactive electronic toy 12 and remote control unit 14 are not sufficient, i.e. less than a threshold power level, low battery indicator beeper is activated and control passes to step 64. In another embodiment, when battery levels of interactive electronic toy 12 and remote control unit 14 are sufficient, i.e. exceeds threshold power level, interactive electronic toy 12 and remote control unit 14 may be ready to use and control passes to step 66.

At step 64, battery packs of interactive electronic toy 12 and remote control unit 14 may be externally charged via first charging terminal 44 and second charging terminal 56, respectively, to a level that exceeds threshold power level. Alternatively, battery packs of interactive electronic toy 12 and remote control unit 14 may be replaced. Accordingly, interactive electronic toy 12 and remote control unit 14 may be ready to use. Control passes to step 66.

At step 66, it may be checked whether mode of operation is automatic or manual. Mode of operation may be set to automatic or manual via one of first set of control buttons 40 or second set of control buttons 54, prior to using interactive electronic toy 12 and remote control unit 14. In an embodiment, mode of operation may be set via hardware buttons at interactive electronic toy 12 and remote control unit 14. In another embodiment, mode of operation may be set by voice command via voice sensors at interactive electronic toy 12. In an embodiment, when mode of operation is set to manual mode, control passes to step 68. In another embodiment, when mode of operation is set to automatic mode, control passes to step 70.

At step 68, when mode of operation is set to manual mode, interactive electronic toy 12 may be configured to receive one or more control signals from remote control unit 14, via communication network 59. In such case, remote control unit 14 may be manually operated by user, such as a child. For example, by using joystick 30, user may perform various operations, for example, forward, backward, or sideways movement of interactive electronic toy 12, based on activated motorized wheels 24 and 26. In another example, by manipulating spin button 34, user may perform spinning movement of interactive electronic toy 12 over activated motorized wheels 24 and 26. In yet another example, by manipulating three LED activation buttons 32, user may activate red, green, blue or a combination of LEDs installed in interactive electronic toy 12. Control passes to step 72.

At step 68, when mode of operation is set to automatic mode, one or more sensors 36 may be activated in interactive electronic toy 12 to detect one or more events in a defined proximity area. In such case, interactive electronic toy 12 may be automatically operated by first microprocessor 38. Events may correspond to a clapping sound, an audio command, a touch gesture, a press gesture, and the like. For example, first microprocessor 38 maybe configured to impart spinning movement to interactive electronic toy 12 when user claps. In another example, first microprocessor 38 maybe configured to activate speaker devices for rendering long beeps when user touches horn 22. In yet another example, first microprocessor 38 may be configured to activate speaker devices for rendering crying sound when user detaches pacifier 20 from interactive electronic toy 12. Control passes to step 72.

At step 72, first microprocessor 38 may be configured to activate set of output devices 46. In an embodiment, as described in step 68, based on one or more control signals received from remote control unit 14, first microprocessor 38 may be configured to impart spinning, forward, backward, or sideways movement of interactive electronic toy 12 when user manipulates spin button 34 or uses joystick 30. First microprocessor 38 may be further configured to activate red, green, blue or a combination of LEDs installed in interactive electronic toy 12 when user manipulates three LED activation buttons 32.

In an embodiment, as described in step 70, based on one or more detected events from one or more sensors 36, first microprocessor 38 may be configured to impart spinning upon clapping, forward, backward, or sideways movement upon voice commands, activation of multi-colored LEDs upon clicking fingers, and the like.

At step 74, set of output devices 46 may be deactivated based on manipulation of one of first set of control buttons 40 or second set of control buttons 54.

In accordance with an embodiment of the disclosure, height of interactive electronic toy 12 may be 1 feet, length may be 17 inches, and width may be ~3.4 inches. Various types of materials utilized to create interactive electronic toy 12 may be felt, cotton, buttons, rubber, straws, yarn, and plastic. However, the above measurements and material are merely for exemplary purpose and should not be construed to be limiting the scope of the disclosure.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An interactive electronic toy, comprising:

a first microprocessor configured to determine a mode of operation;

in an instance in which said mode of operation is a first mode, a receiver is configured to receive one or more control signals from a remote control unit that includes a second microprocessor;

in an instance in which said mode of operation is a second mode, one or more sensors are configured to detect one or more events in a defined proximity area; and a set of output devices and a set of motorized wheels configured to be activated based on said received one or more control signals or said detected one or more events, said set of output devices including speaker devices and a plurality of multi-colored LEDs;

said interactive electronic toy being a remote controlled clown doll having an upper portion, a middle portion and a lower portion, said clown doll includes internal circuitry, said first microprocessor, said one or more sensors and a set of control buttons configured for powering on/off said interactive electronic toy, deactivating said activated set of output devices and deactivating said activated set of motorized wheels;

a face at said upper portion of said interactive electronic toy, said face having ears adjacent to said face at a left side and a right side thereof;

a torso at said middle portion with a first and second limb extending from said torso, said first limb holding a horn element, said speaker devices activated to produce a first sound upon said horn element being touched and said second limb holding a pacifier, said speaker devices activated to produce a second sound upon said pacifier being removed from said second limb, said first sound and said second sound being different;

said set of motorized wheels being roller-skate shoes upon which said clown doll rolls on in a direction indicated by said remote control unit and are located entirely underneath said lower portion;

said remote control unit including an antenna and a joystick extending outwardly and upwardly therefrom, said remote control unit further including a spin button and light emitting diode (LED) activation buttons mounted thereon, said antenna adapted to allow communication between said interactive electronic toy and said remote control unit, said remote control unit propels the clown doll in various directions using said joystick.

2. The interactive electronic toy of claim 1, wherein said first mode is a manual mode and said second mode is an automatic mode.

3. The interactive electronic toy of claim 1, wherein said set of motorized wheels impart a forward, backward, sideways and spinning movement to said interactive electronic toy upon said joystick being manipulated to control directional movement of said interactive toy or said spin button being activated.

4. The interactive electronic toy of claim 1, further comprising a first charging terminal configured to charge a rechargeable battery pack installed in said interactive electronic toy.

5. The interactive electronic toy of claim 1, wherein said remote control unit comprises a transmitter configured to transmit said one or more control signals to said interactive electronic toy via a communication network.

6. The interactive electronic toy of claim 5, wherein said communication network is one of a long distance communication network or a short distance communication network.

7. The interactive electronic toy of claim 4, wherein said remote control unit comprises a second charging terminal configured to charge a rechargeable battery pack installed in said remote control unit.

8. The interactive electronic toy of claim 1, wherein said remote control unit is rectangular shaped.

9. The interactive electronic toy of claim 1, wherein a surface of said middle portion and lower portion are covered by materials, said materials having a pattern thereon.

10. The interactive electronic toy of claim 1, wherein said interactive electronic toy includes three of said light emitting diode (LED) activation buttons.

11. The interactive electronic toy of claim 1, wherein said torso includes big buttons vertically mounted thereon, said big buttons being decorative.

12. The interactive electronic toy of claim 11, wherein said interactive toy includes three of said big buttons.

13. The interactive electronic toy of claim 12, wherein said three big buttons are of red, blue and green color, respectively.

* * * * *